US005624002A

United States Patent [19]

Huffstutler

[11] Patent Number: 5,624,002

[45] **Date of Patent: *Apr. 29, 1997**

[54] ROTARY DRILL BIT

[75] Inventor: Alan D. Huffstutler, Grand Prairie, Tex.

[73] Assignee: Dresser Industries, Inc., Dallas, Tex.

[ * ] Notice: The term of this patent shall not extend beyond the expiration date of Pat. No. 5,439,068.

[21] Appl. No.: 422,140

[22] Filed: Apr. 13, 1995

Related U.S. Application Data

[62] Division of Ser. No. 287,390, Aug. 8, 1994.

[51] Int. Cl.[6] ..... E21B 10/20

[52] U.S. Cl. ..... 175/356; 175/366; 175/375

[58] Field of Search ..... 175/366, 367, 175/369, 356, 375, 371, 368; 76/108.2

[56] References Cited

U.S. PATENT DOCUMENTS

| | | | |
|---|---|---|---|
| Re. 19,339 | 10/1934 | Vertson | 255/73 |
| Re. 32,495 | 9/1987 | Coates | 175/339 |
| D. 265,205 | 6/1982 | Munson | D15/139 |
| 1,906,427 | 5/1933 | Sievers et al. . | |
| 1,908,049 | 5/1933 | Reed | 175/367 X |
| 2,030,723 | 2/1936 | Scott et al. | 255/71 |
| 2,047,112 | 7/1936 | Reed | 175/363 |
| 2,063,012 | 12/1936 | Catland | 175/357 |
| 2,064,273 | 12/1936 | Scott | 175/342 |
| 2,065,743 | 12/1936 | Reed | 255/71 |
| 2,068,375 | 1/1937 | Catland | 175/357 |
| 2,124,521 | 7/1938 | Williams et al. | 255/71 |
| 2,151,347 | 3/1939 | Fisher | 255/71 |
| 2,176,358 | 10/1939 | Pearce | 175/371 X |
| 2,260,487 | 10/1941 | Scott | 225/71 |
| 2,318,370 | 5/1943 | Burch | 255/71 |
| 2,634,105 | 4/1953 | Gruner | 175/356 X |
| 2,648,526 | 8/1953 | Lanchester | 255/71 |

(List continued on next page.)

FOREIGN PATENT DOCUMENTS

| | | | |
|---|---|---|---|
| 936382 U | 6/1955 | Germany . | |
| 936382 | 12/1955 | Germany | 175/366 |
| 533719 | 10/1976 | U.S.S.R. . | |
| 1305295 | 4/1987 | U.S.S.R. . | |
| 1467157 | 3/1989 | U.S.S.R. . | |

OTHER PUBLICATIONS

Security/Dresser "Security Oilfield Catalog" Rock Bits, Diamond Products, Drilling Tools, *Security Means Technology*, Nov., 1991.

"State of the Science in Rock Bit Techn." by Carlos Fernandez, Spacebit, Aug. 8, 1991.

*Primary Examiner*—Hoang C. Dang
*Attorney, Agent, or Firm*—Baker & Botts, L.L.P.

[57] ABSTRACT

A rotary cone drill bit having a one-piece bit body with a lower portion having a convex exterior surface and an upper portion adapted for connection to a drill string. The drill bit will generally rotate around a central axis of the bit body to form a borehole. A number of support arms are preferably attached to pockets formed in the bit body and depend therefrom. The bit body and support arms cooperate with each other to reduce initial manufacturing costs and to allow rebuilding of a worn drill bit. Each support arm has an inside surface with a spindle connected thereto and an outer shirttail surface. Each spindle projects generally downwardly and inwardly with respect to the longitudinal axis of the associated support arm and the central axis of the bit body. A number of cone cutter assemblies equal to the number of support arms are mounted respectively on each of the spindles. The radial spacing of the support arms on the perimeter of the associated bit body along with their respective length and width dimensions are selected to enhance fluid flow between the cutter cone assemblies mounted on the respective support arms and the lower portion of the bit body. The resulting drill bit provides enhanced fluid flow, increased seal and bearing life, improved downhole performance and standardization of manufacturing and design procedures.

13 Claims, 7 Drawing Sheets

U.S. PATENT DOCUMENTS

| | | | |
|---|---|---|---|
| 2,782,005 | 2/1957 | Appleton | 255/340 |
| 2,950,090 | 8/1960 | Swart | 175/375 |
| 3,130,801 | 4/1964 | Schumacher, Jr. | 175/374 |
| 3,442,342 | 5/1969 | McElya et al. | 175/374 |
| 3,628,616 | 12/1971 | Neilson | 175/375 |
| 3,800,891 | 4/1974 | White et al. | 175/374 |
| 3,825,083 | 7/1974 | Flarity et al. | 175/394 |
| 3,850,256 | 11/1974 | McQueen | 175/228 |
| 4,054,772 | 10/1977 | Lichte | 219/121 |
| 4,056,153 | 11/1977 | Miglierini | 175/376 |
| 4,067,406 | 1/1978 | Garner et al. | 175/341 |
| 4,098,448 | 7/1978 | Sciaky et al. | 228/102 |
| 4,145,094 | 3/1979 | Verizan | 308/8.2 |
| 4,209,124 | 6/1980 | Baur et al. | 228/182 |
| 4,256,194 | 3/1981 | Varel | 175/375 |
| 4,280,571 | 7/1981 | Fuller | 175/337 |
| 4,333,364 | 6/1982 | Varel | 76/108 |
| 4,350,060 | 9/1982 | Vezirian | 76/108 |
| 4,352,400 | 10/1982 | Grappendorf et al. | 175/330 |
| 4,369,849 | 1/1983 | Parrish | 175/366 X |
| 4,417,629 | 11/1983 | Wallace | 175/365 |
| 4,421,184 | 12/1983 | Mullins | 175/337 |
| 4,552,232 | 11/1985 | Frear | 175/337 |
| 4,623,027 | 11/1986 | Vezirian | 175/340 |
| 4,624,329 | 1/1986 | Evans et al. | 175/374 |
| 4,630,693 | 12/1986 | Goodfellow | 175/366 |
| 4,635,728 | 1/1987 | Harrington | 166/341 |
| 4,711,143 | 12/1987 | Loukanis et al. | 76/108 |
| 4,727,943 | 3/1988 | Wood | 175/229 |
| 4,750,573 | 6/1988 | Wynn | 175/359 |
| 4,765,205 | 8/1988 | Higdon | 76/108 |
| 4,813,502 | 3/1989 | Dysart | 175/337 |
| 4,817,852 | 4/1989 | Hill | 228/114 |
| 4,848,491 | 7/1989 | Burridge et al. | 175/329 |
| 4,986,375 | 1/1991 | Maher | 175/323 |
| 5,040,623 | 8/1991 | Vezirian | 175/354 |
| 5,074,367 | 12/1991 | Estes | 175/374 |
| 5,131,478 | 7/1992 | Brett | 175/57 |
| 5,145,016 | 9/1992 | Estes | 175/331 |
| 5,158,148 | 10/1992 | Keshavan | 175/426 |
| 5,189,932 | 3/1993 | Palmo et al. | 76/108.2 |
| 5,199,516 | 4/1993 | Fernandez | 175/366 |
| 5,224,560 | 7/1993 | Fernandez | 175/374 |
| 5,281,260 | 1/1994 | Kunar et al. | 75/240 |
| 5,289,889 | 3/1994 | Gearhart | 175/325.5 |
| 5,351,768 | 10/1994 | Scott et al. | 175/374 |
| 5,439,067 | 8/1995 | Huffstutler | 175/339 |
| 5,439,068 | 8/1995 | Huffstutler | 175/356 |

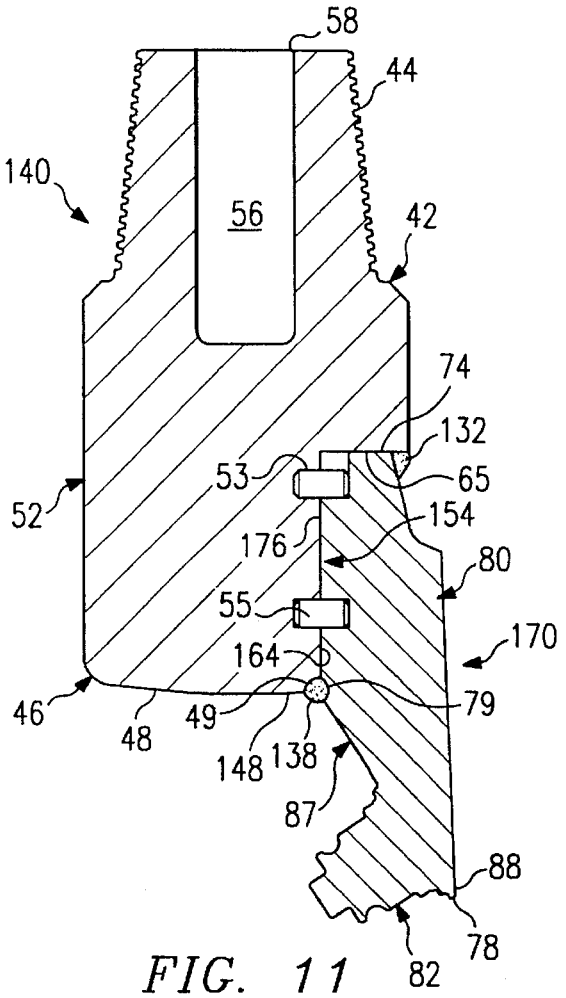
FIG. 11
FIG. 12
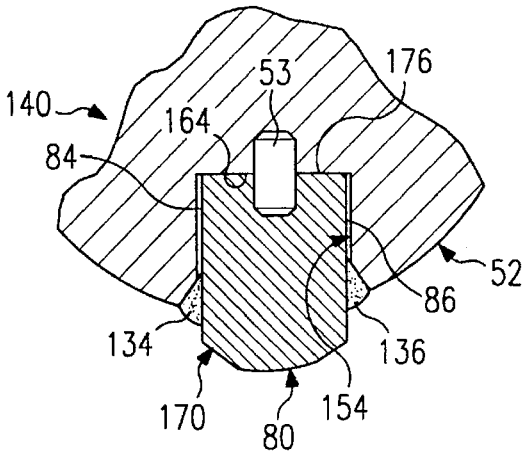
FIG. 13
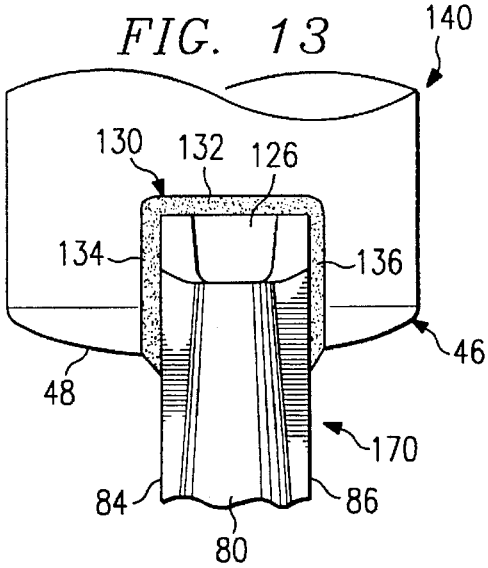
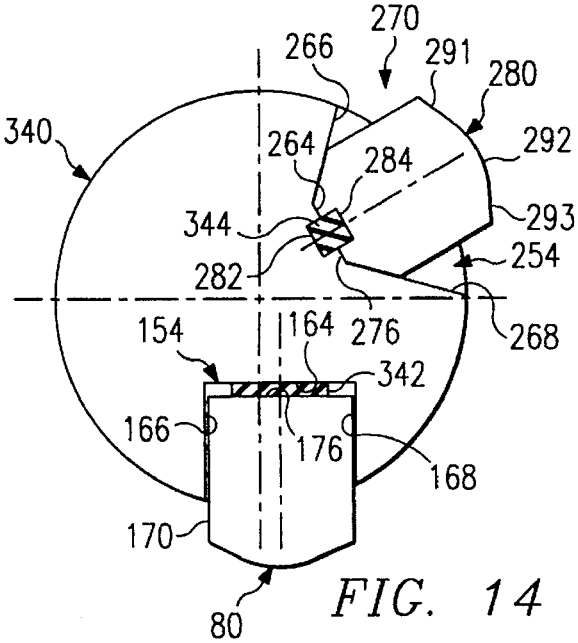
FIG. 14

ROTARY DRILL BIT

RELATED APPLICATION

This application is a divisional of application Ser. No. 08/287,390 filed Aug. 8, 1994, entitled Rotary Drill Bit and Method for Manufacture and Rebuild (Attorney's Docket 60220-0172), and related to application entitled Modular Rotary Drill Bit, U.S. Pat. No. 5,439,068 dated Aug. 8, 1995 (Attorney's Docket 60220-0170); copending application entitled Rotary Cone Drill Bit With Improved Support Arms, Ser. No. 08/287,441 filed Aug. 8, 1994 (Attorney's Docket 60220-0171); application entitled Rock Bit With Enhanced Fluid Return Area, U.S. Pat. No. 5,439,067 dated Aug. 8, 1995 (Attorney's Docket 60220-0169); copending application entitled Rotary Drill Bit, Ser. No. 29/033,599 filed 01/17/95 (Attorney's Docket 60220-0173); and copending application entitled Support Arm and Rotary Cone for Modular Drill Bit, Ser. No. 29/033,630 filed Jan. 17, 1995 (Attorney's Docket 60220-0174).

TECHNICAL FIELD OF THE INVENTION

This invention relates in general to rotary drill bits used in drilling a borehole in the earth and in particular to methods for manufacturing and rebuilding a drill bit having a one-piece bit body with one or more support arms and cutter cone assemblies attached thereto.

BACKGROUND OF THE INVENTION

Various types of rotary drill bits or rock bits may be used to form a borehole in the earth. Examples of such rock bits include roller cone bits or rotary cone bits used in drilling oil and gas wells. A typical roller cone bit comprises a bit body with an upper end adapted for connection to a drill string. A plurality of support arms, typically three, depend from the lower end portion of the bit body with each arm having a spindle protruding radially inward and downward with respect to a projected rotational axis of the bit body.

Conventional roller cone bits are typically constructed from three segments. The segments may be positioned together longitudinally with a welding groove between each segment. The segments may then be welded with each other using conventional techniques to form the bit body. Each segment also includes an associated support arm extending from the bit body. An enlarged cavity or passageway is typically formed in the bit body to receive drilling fluids from the drill string. U.S. Pat. No. 4,054,772 entitled, Positioning System for Rock Bit Welding shows a method and apparatus for constructing a three cone rotary rock bit from three individual segments. U.S. Pat. No. 4,054,772 is incorporated by reference for all purposes within this application.

A cutter cone assembly is generally mounted on each spindle and supported rotatably on bearings acting between the spindle and the inside of a spindle receiving cavity or chamber in the cutter cone assembly. One or more nozzle housings may be formed on the bit body adjacent to the support arms. A nozzle is typically positioned within each housing to direct drilling fluid passing downwardly from the drill string through the bit body toward the bottom of the borehole being formed. Drilling fluid is generally provided by the drill string to perform several functions including washing away material removed from the bottom of the borehole, cleaning the cutter cone assemblies, and carrying the cuttings radially outward and then upward within the annulus defined between the exterior of the bit body and the wall of the borehole. U.S. Pat. No. 4,056,153 entitled, Rotary Rock Bit with Multiple Row Coverage for Very Hard Formations and U.S. Pat. No. 4,280,571 entitled, Rock Bit show examples of conventional roller cone bits with cutter cone assemblies mounted on a spindle projecting from a support arm. U.S. Pat. No. 4,056,153 and U.S. Pat. No. 4,280,571 are incorporated by reference for all purposes within this application.

While drilling with such rotary bits or rock bits, cuttings and other types of debris may collect in downhole locations with restricted fluid flow. Examples of such locations with restricted fluid flow include the lower portion of the bit body adjacent to the respective support arms, the annulus area between the exterior of the bit body and the adjacent wall of the borehole. Other areas of restricted fluid flow may include the backface of the respective cutter cone assemblies, portion of the support arms and the wall of the borehole. As a result of collecting such debris, the area available for fluid flow is reduced even further resulting in an increase in fluid velocity through such areas and erosion of the adjacent metal components. As this erosion progresses, vital components such as bearings and seals may be exposed to drilling fluids and well debris which can lead to premature failure of the associated rock bit.

SUMMARY OF THE INVENTION

In accordance with the present invention, the disadvantages and problems associated with previous rock bits and rotary cone drill bits have been substantially reduced or eliminated. One aspect of the present invention includes a one-piece or unitary bit body having support arms attached to pockets formed in the bit body and a cutter cone assembly mounted on a spindle projecting from each support arm. The bit body, support arms and associated cutter cone assemblies cooperate with each other to provide enhanced fluid flow around the exterior of the bit body and support arms during drilling operations resulting in reduced erosion and enhanced removal of cuttings and other debris from the bottom of the borehole to the well surface.

Important technical advantages of providing a rotary cone drill bit having a one-piece bit body with support arms attached to respective pockets in accordance with teachings of the present invention include significant improvements in manufacturing and assembly of the rock bit. Such improvements result from standardizing the design of the support arms and reducing the overall amount of raw material required to form each support arm. Also, the bit body and support arms may be manufactured from different types of material to improve downhole performance of the resulting drill bit and to reduce manufacturing costs. The configuration of the support arms and their associated pockets cooperate with each other to provide alignment and proper positioning of the support arms with respect to the bit body prior to welding each support arm with its associated pocket. Welding grooves or welding surfaces may be formed between the exterior or perimeter of each pocket and adjacent portions of the support arm attached to each pocket.

Another aspect of the present invention includes the use of support arms having reduced weight and a relatively slim length to width ratio as compared to previous rotary cone drill bits. As a result of the reduced weight and smaller configuration, cost savings may be achieved through reduced shipping costs per support arm and performing heat treating and other batch type processes on a larger number of support arms at one time. Cost savings resulting from standardization include reduced lead time to obtain components for each drill bit, fewer machine setups to manufacture each support arm, and fewer drawings and manufacturing files which require updating when a design change is made. One of the significant cost savings results from the ability to offer customers the same wide range of drill bit sizes and offsets while substantially reducing the number of component parts which must be maintained in inventory to produce each different size and type of drill bit.

Another aspect of the present invention includes providing a rotary cone drill bit having a one-piece bit body, support arms, and cutter cone assemblies which may be easily replaced to rebuild the respective drill bit. Depending upon the condition of the associated drill bit after drilling a wellbore, the bit body, one or more support arms, and/or one or more cutter cone assemblies may be replaced or reused on other drill bits as appropriate. If a cutter cone assembly is worn, the cutter cone assembly and associated support arm may be removed from the associated pocket and a new cutter cone assembly placed on the support arm and rewelded with the pocket. Conversely, both the support arm and the cutter cone assembly can be removed and a complete new support arm/cutter cone assembly welded to the associated pocket. Various combinations of support arms and bit bodies may be used to rebuild or remanufacture a drill bit in accordance with the teachings of the present invention.

Another aspect of the present invention includes a rotary cone drill bit having a one-piece bit body with at least three support arms disposed within pockets formed in the exterior of the bit body. The dimensions of each support arm and its associated pocket are preferably selected such that a substantial portion of the thickness of each support arm is contained within the associated pocket. For one application longitudinal welds may be provided between each side of the support arm and the adjacent portions of the associated pocket. The length of the longitudinal welds is preferably equal to or greater than the width of the respective support arm.

Further important technical advantages of the present invention include forming a rotary cone drill bit from a one-piece bit body having an enlarged fluid cavity formed therein to receive drilling fluids and other fluids from a drill string attached to the drill bit. The one-piece bit body and its fluid cavity allow locating fluid nozzles near the center line of the bit body and/or any other desired location during the manufacture of the bit body rather than forming the necessary fluid flow paths and nozzle housings after the rotary cone drill bit has been substantially assembled. The fluid passageways and their associated nozzles can be located within the bit body without concern for welded seams found in conventional rotary drill bits which simplifies the manufacturing procedures associated with a rotary cone drill bit incorporating the present invention. The desired fluid passageways can be machined prior to attaching the support arms with the one-piece bit body. Also, since welded seams are not required to fabricate the one-piece bit body, problems associated with erosion of welded seams and/or weld porosity during downhole drilling operations have been eliminated.

A further aspect of the present invention includes manufacturing a rotary cone drill bit having a one-piece bit body with pockets formed in the exterior of the bit body for attaching a number of support arms and associated cutter cone assemblies to the bit body. For one application, an energizer or other resilient means may be disposed between each support arm and its associated pocket prior to welding the support arm with the perimeter of the associated pocket. A welding fixture may also be used in cooperation with the energizers to ensure that the support arias and their associated cutter cone assemblies have the desired outside diameter and overall geometric configuration for the resulting drill bit. The welding fixture in combination with the energizers allows adjusting the position of each support arm and its associated cutter cone assembly as required to obtain the desired geometric configuration for the resulting drill bit with a high degree of accuracy and repeatability during both the initial manufacture and later rebuilding of the associated drill bit. For some applications, multiple welds may be formed between each support arm and its associated pocket extending over the full perimeter of the associated pocket and adjacent portions of each support arm.

BRIEF DESCRIPTION OF THE DRAWINGS

For a more complete understanding of the present invention, and the advantages thereof, reference is now made to the following descriptions taken in conjunction with the accompanying drawings, in which:

FIG. 11 is a schematic drawing in section showing a unitary bit body having a support arm attached thereto in accordance with an embodiment of the present invention;

FIG. 12 is an enlarged schematic drawing in section with portions broken away showing another view of the bit body and support arm of FIG. 11;

FIG. 13 is an schematic drawing in elevation with portions broken away showing another view of the bit body and support arm of FIG. 11;

FIG. 14 is a schematic drawing in section showing alternative configurations for attaching support arms with a unitary bit body in accordance with further embodiments of the present invention;

DETAILED DESCRIPTION OF THE INVENTION

Figure 1:
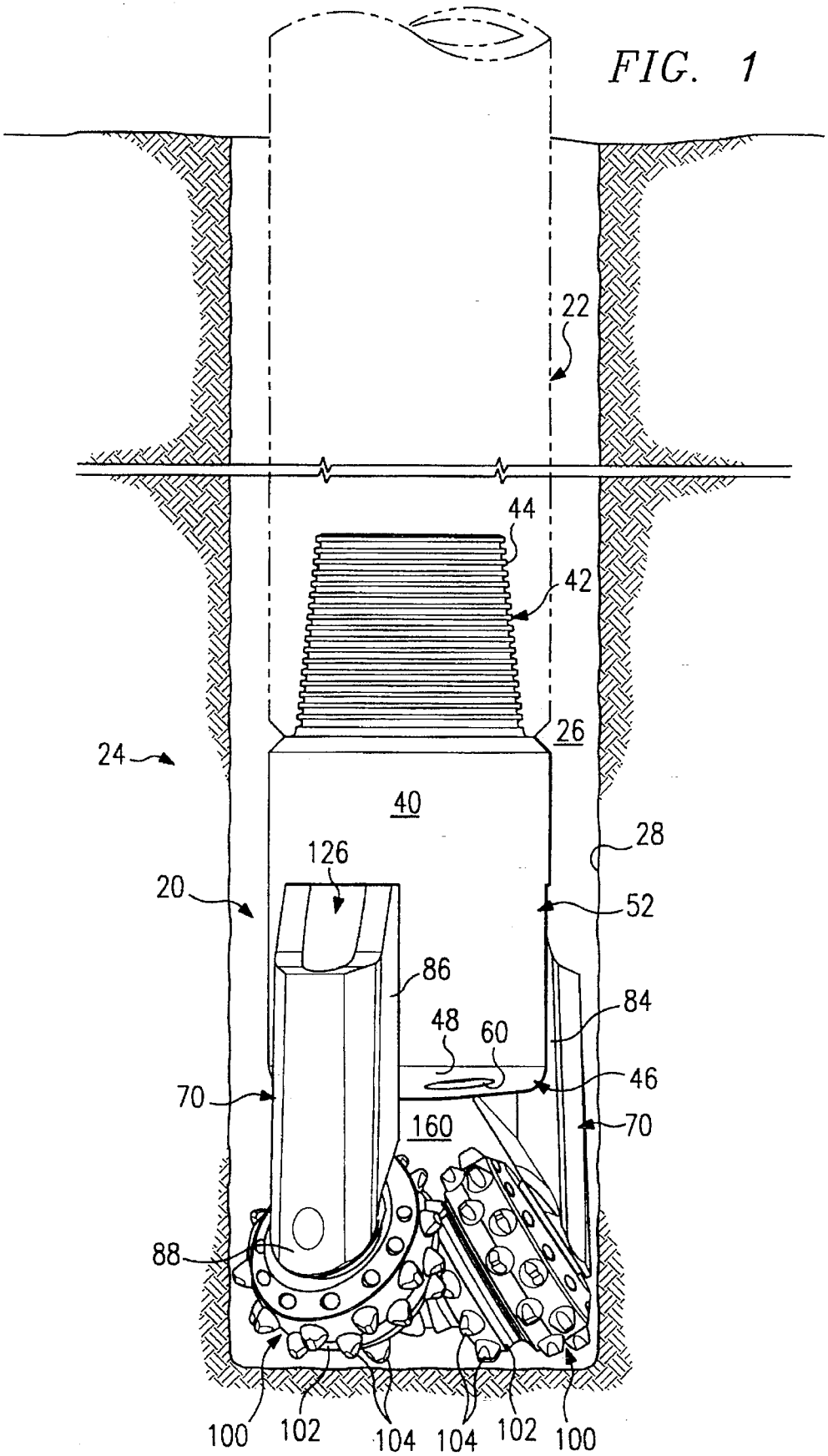
FIG. 1 is a schematic drawing in elevation and in section with portions broken away showing a rotary cone drill bit, incorporating features of the present invention attached to one end of a drill string disposed in a borehole.

The preferred embodiments of the present invention and its advantages are best understood by referring to FIGS. 1–16 of the drawings, like numerals being used for like and corresponding parts of the various drawings.

As shown in the drawings for purposes of illustration, the present invention is embodied in rotary cone drill bit 20 of the type used in drilling a borehole in the earth. Rotary cone drill bit 20 may sometimes be referred to as a "rotary drill bit" or "rock bit." Rotary cone drill bit 20 preferably includes threaded connection or pin 44 for use in attaching drill bit 20 with drill string 22. Threaded connection 44 and the corresponding threaded connections (not shown) associated with drill string 22 are designed to allow rotation of drill bit 20 in response to rotation of drill string 22 at the well surface.

As shown in FIG. 1, drill bit 20 may be attached to drill string 22 and disposed in borehole 24. Annulus 26 is formed between the exterior of drill string 22 and the interior or wall 28 of borehole 24. In addition to rotating drill bit 20, drill string 22 is often used to provide a conduit for communicating drilling fluids and other fluids from the well surface to drill bit 20 at the bottom of borehole 24. Such drilling fluids may be directed to flow from drill string 22 to various nozzles 60 provided in drill bit 20. Cuttings formed by drill bit 20 and any other debris at the bottom of borehole 24 will mix with the drilling fluids exiting from nozzles 60 and return to the well surface via annulus 26.

For rotary cone drill bit 20 cutting action or drilling action occurs as cutter cone assemblies 100 are rolled around the bottom of borehole 24 by rotation of drill string 22. The resulting inside diameter of borehole 24 defined by wall 28 corresponds approximately with the outside diameter or gauge diameter of cutter cone assemblies 100. Cutter cone assemblies 100 cooperate with each other to form wall 28 of borehole 24 in response to rotation of drill bit 20. Cutter cone assemblies 100 may sometimes be referred to as "rotary cone cutters" or "roller cone cutters".

Figure 2:
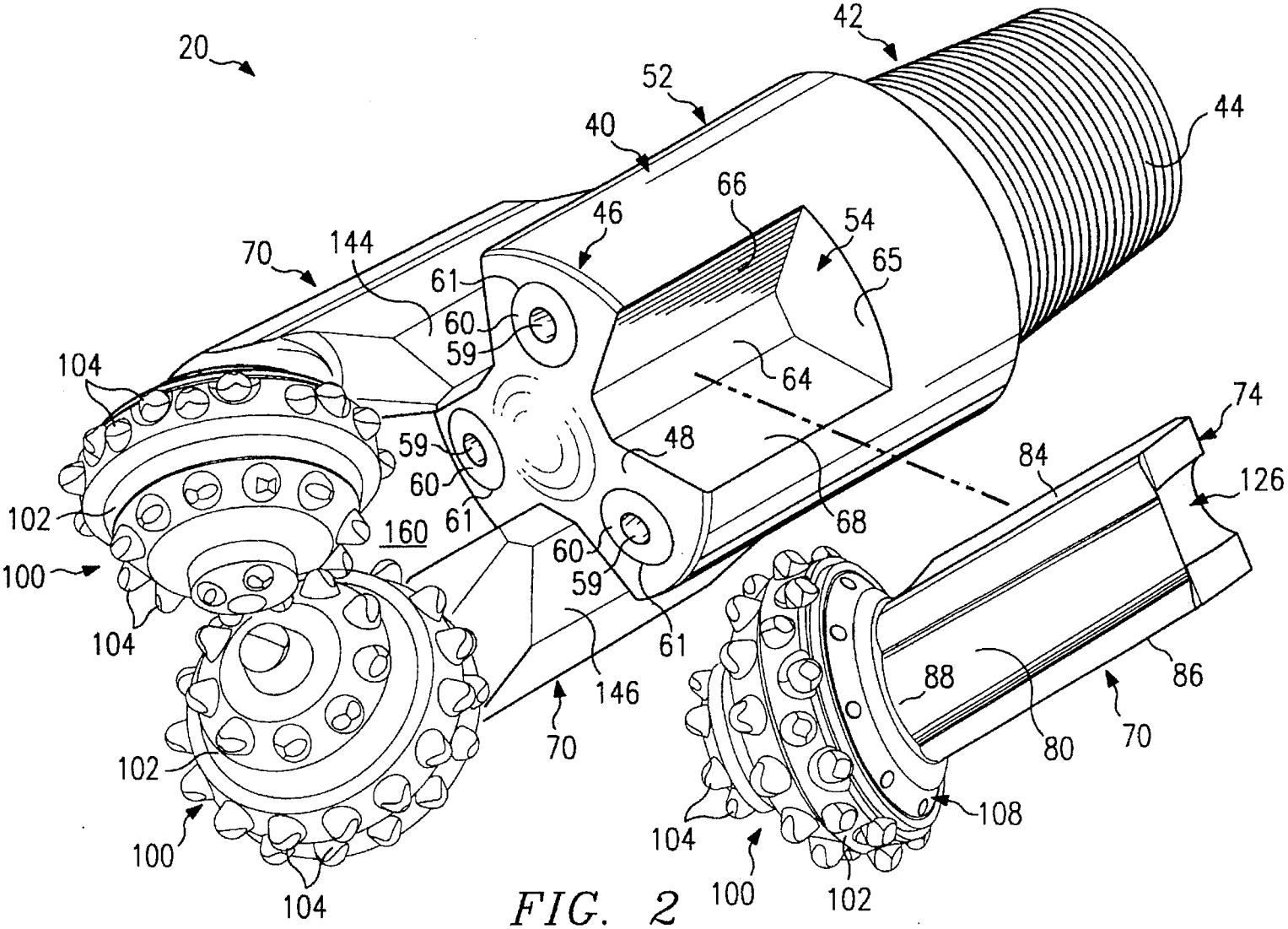
FIG. 2 is an isometric drawing showing a partially exploded view of a rotary cone drill bit incorporating an embodiment of the present invention.
Figure 3:
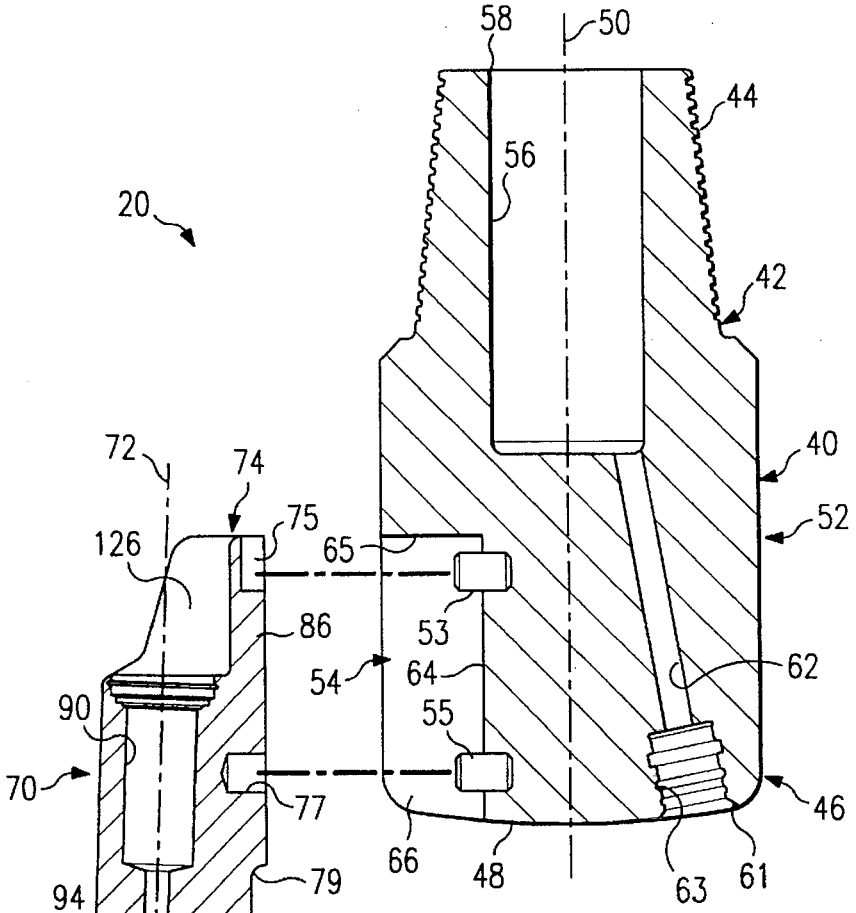
FIG. 3 is an exploded drawing partially in section showing portions of a one-piece bit body, support arm, and cutter cone assembly incorporating an embodiment of the present invention.

As shown in FIGS. 1, 2, and 3 each cutter cone assembly 100 includes cutting edges 102 with protruding inserts 104 which scrape and gouge against the sides and bottom of borehole 24 in response to the weight and rotation applied to drill bit 20 from drill string 22. The position of cutting edges 102 and inserts 104 for each cutter cone assembly 100 may be varied to provide the desired downhole cutting action. Other types of cutter cone assemblies may be satisfactorily used with the present invention including, but not limited to, cutter cone assemblies having milled teeth instead of inserts 104. Cuttings and other debris created by drill bit 20 may be carried from the bottom of borehole 24 to the well surface by drilling fluids exiting from nozzles 60. The debris carrying fluid generally flows radially outward from beneath drill bit 20 and then flows upward towards the well surface through annulus 26.

Drill bit 20 preferably comprises a one-piece or unitary bit body 40 with upper portion 42 having threaded connection or pin 44 adapted to secure drill bit 20 with the lower end of drill string 22. Three support arms 70 are preferably attached to and extend longitudinally from bit body 40 opposite from pin 44. Each support arm 70 preferably includes spindle 82 connected to and extending from inside surface 76 of the respective support arm 70. An important feature of the present invention includes the ability to manufacture unitary bit body 40 from a generally cylindrical piece of raw material or bar stock (not shown) having approximately the desired length and outside diameter required for the finished bit body 40. Also, support arms 70 may be manufactured from forgings having approximately the desired general configuration and major dimensions which reduces overall manufacturing costs associated with producing each support arm 70 and the resulting drill bit 20.

Bit body 40 includes lower portion 46 having a generally convex exterior surface 48 formed thereon. The dimensions of convex surface 48 and the location of cutter cone assemblies 100 are selected to optimize fluid flow between lower portion 46 of bit body 40 and cutter cone assemblies 100. As will be explained later in more detail, the location of cutter cone assemblies 100 relative to lower portion 46 may be varied by adjusting the length of the associated support arm 70 and the spacing between each support arm 70 on the exterior of bit body 40.

As shown in FIGS. 1, 2 and 3, bit body 40 includes middle portion 52 disposed between upper portion 42 and lower portion 46. Longitudinal axis or central axis 50 extends through bit body 40 and corresponds generally with the projected axis of rotation for drill bit 20. Middle portion 52 preferably has a generally cylindrical configuration with pockets 54 formed in the exterior thereof and spaced radially from each other. The number of pockets 54 is selected to correspond with the number of support arms 70 which will be attached thereto. The spacing between pockets 54 in the exterior of middle portion 52 is selected to correspond with the desired spacing between support arms 70 and their associated cutter cone assemblies 100. Also, any desired offset between support arms 70 and their associated cutter cone assemblies 100 with respect to longitudinal axis 50 and the projected axis of rotation for drill bit 20 may be provided by varying the position of each pocket 54 with respect to longitudinal axis 50.

Each support arm 70 has a longitudinal axis 72 extending therethrough. Support arms 70 are preferably positioned in their respective pockets 54 with their respective longitudinal axis 72 aligned substantially parallel with each other and with longitudinal axis 50 of the associated bit body 40. Back wall 64 of each pocket 54 cooperates with inside surface 76 of the associated support arm 70 to establish the desired alignment of longitudinal axis 72 with respect to longitudinal axis 50. As will be explained later in more detail, various mechanisms may be provided on inside surface 76 of each support arm 70 to assist with alignment and positioning of each support arm 70 within its associated pocket 54 during fabrication of drill bit 20.

For one application a portion of each support arm 70 is preferably welded within its associated pocket 54 by a series of welds formed between the exterior or perimeter of each pocket 54 and adjacent portions of the associated support arm 70. The perimeter of each pocket 54 adjacent to the exterior of bit body 40 may be modified to provide welding surfaces and/or welding grooves to assist in attaching each support arm 70 with its associated pocket 54.

FIG. 3 is an exploded drawing which shows the relationship between bit body 40, one of the support arms 70 and its associated cutter cone assembly 100. Each cutter cone assembly 100 may be constructed and mounted on its associated spindle 82 in a substantially identical manner. Each support arm 70 is preferably constructed and attached to its associated pocket 54 in substantially the same manner. Therefore, only one support arm 70 and cutter cone assembly 100 will be described in detail since the same description applies generally to the other two support arms 70 and their associated cutter cone assemblies 100.

Support arm 70 has a generally rectangular configuration with respect longitudinal axis 72. Support arm 70 may have various cross-sections taken normal to longitudinal axis 72 depending upon the configuration of the associated pocket 54 and other features which may be incorporated into support arm 70 in accordance with the teachings of the present invention. Support arm 70 includes top surface 74, inside surface 76, bottom edge 78 and exterior surface 80. Support arm 70 also includes sides 84 and 86 which preferably extend substantially parallel with longitudinal axis 72.

Various features of the present invention may be incorporated as part of inside surface 76, exterior surface 80 and sides 84 and 86. The various dimensions of each support arm 70 are selected to be compatible with the associated pocket 54. As shown in FIGS. 2 and 3, a portion of each support arm 70 including upper end or top surface 74 and adjacent portions of inside surface 76 along with sides 84 and 86 may be sized to fit within the associated pocket 54. The configuration of inside surface 76 may be modified substantially between top surface 74 and bottom edge 78 as desired to provide various features of the present invention. Inside surface 76 and exterior surface 80 are contiguous at bottom edge 78 of support arm 70. The portion of exterior surface 80 formed adjacent to bottom edge 78 is often referred to as shirttail surface 88.

For one embodiment of the present invention as shown in FIG. 3, first opening 75 and second opening 77 may be formed in inside surface 76 of each support arm 70. First post or dowel 53 and second post or dowel 55 may be disposed in back wall 64 of each pocket 54. Posts 53 and 54 extend radially from each back wall 64 to cooperate respectively with first opening 75 and second opening 77 to position and align each support arm 70 within its associated pocket 54 during assembly of drill bit 20.

For one embodiment of the present invention, first opening 75 preferably comprises a longitudinal slot extending from top surface 74 and sized to receive first post 53 therein. Second opening 77 preferably has a generally circular configuration sized to receive second post 55 therein. First opening 75 is preferably formed as a longitudinal slot to compensate for any variation between the dimension of support arm 70 and its associated pocket 54, including the relative position of first opening 75, second opening 77 and the respective first post 53 and second post 55. Alternatively, posts or dowels 53 and 54 could be initially disposed in and extend from inside surface 76 of support arm 70 with appropriate openings provided in back wall 64 of the associated pocket 54. The location of second opening 77 and second post 55 is preferably selected to prevent interference with welds formed between the perimeters of pocket 54 and adjacent portions of support arm 70. As shown in FIG. 3, second opening 77 is spaced longitudinally from welding groove 79 on inside surface 76 of support arm 70.

The configuration of first opening 75 and second opening 77 along with posts 53 and 54 is particularly beneficial during the manufacture and/or rebuilding of the associated drill bit 20. For example, one of the support arms 70 may be removed from its associated pocket 54 and a new support arm 70 installed therein even though the new support arm 70 may be manufactured with some variation from the dimensions of the original support arm 70. As will be discussed later in more detail, energizer 342 or 344 and welding fixture 200 further cooperate with each other to compensate for variations in tolerances during both manufacture and rebuilding of drill bit 20.

Spindle 82 is preferably angled downwardly and inwardly with respect to both longitudinal axis 72 of support arm 70 and the projected axis of rotation of drill bit 20. This orientation of spindle 82 results in the exterior of cutter cone assembly 100 engaging the side and bottom of borehole 24 during drilling operations. For some applications, it may be desirable to position each support arm 70 and its associated spindle 82 with cutter cone assembly 100 at an offset from the projected axis of rotation of drill bit 20. The desired offset can be easily obtained by forming the associated pockets 54 in the exterior of bit body 40 with a corresponding offset from longitudinal axis 50 of bit body 40. The amount of offset may vary from zero to five or six degrees or zero inches to one half an inch or more in the direction of rotation of drill bit 20.

As shown in FIGS. 1, 2 and 3, each cutter cone assembly 100 preferably includes base portion 108 with a conically shaped shell or tip 106 extending therefrom. For some applications, base portion 108 includes a frustoconically shaped outer surface 110 which is preferably angled in a direction opposite from the angle of shell 106. Base 108 also includes backface 112 which may be disposed adjacent to portions of inside surface 76 of the associated support arm 70. Base 108 preferably includes opening 120 with chamber 114 extending therefrom. Chamber 114 preferably extends through base 108 and into tip 106. The dimensions of opening 120 and chamber 114 are selected to allow mounting each cutter cone assembly 100 on its associated spindle 82. One or more bearing assemblies 122 are preferably mounted on spindle and disposed between a bearing wall within chamber 114 and annular bearing surface 81 on spindle 82. A conventional ball retaining system 124 may be used to secure cutter cone assembly 100 to spindle 82.

Cutter cone assembly 100 may be manufactured from any hardenable steel or other high strength engineering alloy which has adequate strength, toughness, and wear resistance to withstand the rigors of downhole drilling. Protection of bearing assembly 122 and any other bearings within chamber 114, which allow rotation of cutter cone assembly 100 can lengthen the useful service life of drill bit 20. Once drilling debris is allowed to infiltrate between the bearing surfaces of cutter cone assembly 100 and spindle 82, failure of drill bit 20 will follow shortly. The present invention provides for enhanced fluid flow around the exterior of drill bit 22 and the associated support arms 70 and cutter cone assemblies 100 to help keep debris from entering between the various bearing surfaces of each cutter cone assembly 100 and its associated spindle 82. Often an elastomeric seal such as seal 116 may be disposed within the gap between the bearing surfaces of cutter cone assembly 100 and its associated spindle 82. However, once seal 116 fails, drilling fluids and other debris can quickly contaminate the bearing surfaces via the gap between cutter cone assembly 100 and its associated spindle 82.

For some applications, bit body 40 may be fabricated or machined from a generally cylindrical, solid piece of raw material (not shown) having the desired metallurgical characteristics for the resulting drill bit 20. AISI 8620 alloy steel is an example of the type of material which may be used to form bit body 40.

Threaded connection 44 may be formed on upper portion 42 of bit body 40 using conventional threading techniques.

One of the primary requirements in determining the outside diameter of middle portion 52 of bit body 40 is the amount of material thickness required to provide threaded connection 44. The following API table for roller bit connections shows various sizes of drill bits and the required pin size.

ROLLER BIT CONNECTIONS

| 1 Size of Bit, inches | 2 Size and Style of Rotary Pin Connection | 3 Bit Sub Bevel Dia. ± 1/64 inches | 4 Bit Sub Bevel Dia. ± 1/64 inches |
|---|---|---|---|
| 3¾ and 4½, incl. | 2⅜ REG | 3 3/64 | 3 5/64 |
| 4⅝ to 5, incl. | 2⅞ REG | 3 39/64 | 3 11/64 |
| 5⅛ to 7⅝, incl. | 3½ REG | 4 7/64 | 4 9/64 |
| 7½ to 9⅝, incl. | 4½ REG | 5 21/64 | 5 23/64 |
| 9½ to 14½, incl. | 6⅝ REG | 7 23/64 | 7 25/64 |
| 14⅝ to 18½, incl. | 7⅝ REG | 8 15/32 | 8½ |
| 18⅝ and larger | 8⅝ REG | 9 35/64 | 9 37/64 |

The size of drill bit 20 is typically determined by the maximum outside diameter or gauge diameter associated with the three cutter cone assemblies 100. The position of each cutter cone assembly 100 and their combined gauge diameter relative to the :projected axis of rotation of drill bit 20 is a function of the dimensions of pockets 54 and their associated support arms 70 with cutter cone assemblies 100 mounted respectively thereon. Support arms 70 having various sizes of cutter cone assemblies 100 may be attached to pockets 54 to provide the desired gauge diameter or size for drill bit 20.

The dimensions of spindle 82 are preferably selected to accommodate both the largest and smallest cutter cone assembly 100 which will be mounted on the associated support arm 70. Thus, the same one-piece bit body 40 having threaded connection 44 appropriate for a 7½ inch drill bit may also be used for a 9⅜ inch drill bit or any drill bit size therebetween. It is important to note that as the drill bit size increases from 7½ inches to 9⅜ inches, the outside diameter of middle portion 52 of bit body 40 can remain essentially the same. Therefore, the flow area in annulus 26 between the exterior of bit body 40 and wall 28 of borehole 24 is substantially enhanced for a 9⅜ inch drill bit as compared to a 7½ inch drill bit.

Figure 4:
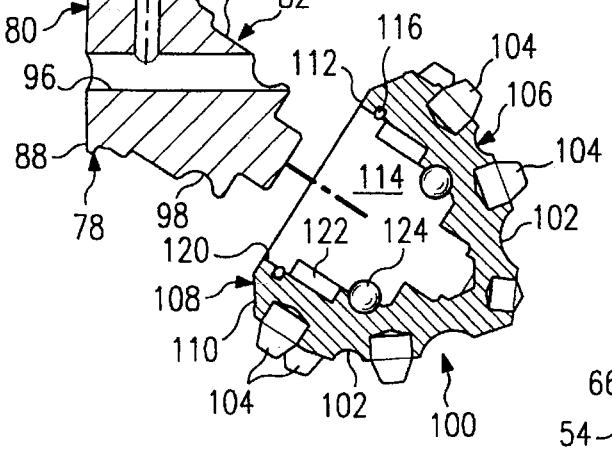
FIG. 4 is an end view of the bit body shown in FIG. 3.
Figure 4:
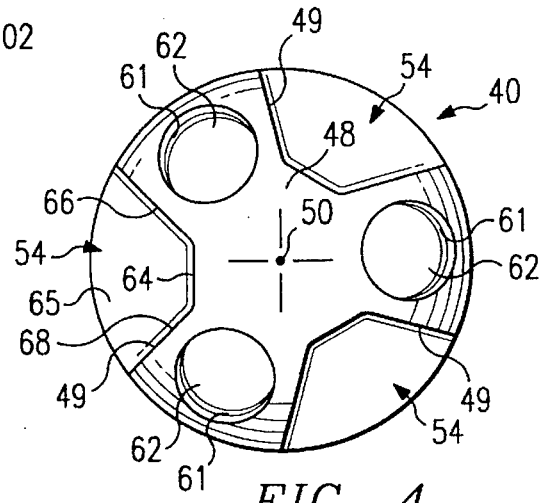

As best shown in FIG. 4, each pocket 54 includes back wall 64 and a pair of side walls 66 and 68. The dimensions of back wall 64 and side walls 66 and 68 are selected to be compatible with the adjacent inside surface 76 and sides 84 and 86 of the associated support arm 70. Also, each pocket 54 preferably includes upper surface 65 formed as an integral part thereof to engage top surface 74 of the associated support arm 70. The width ($W_p$) of each pocket is selected to accommodate the associated support arm 70. An important feature for one embodiment of the present invention includes limiting width of support arms 70. By limiting the width of support arms 70, sufficient void space 160 is provided between adjacent support arms 70 to allow for enhanced fluid flow between support arms 70 and convex surface 48 on lower portion 46 of bit body 40.

Another important feature of the present invention includes the ability to vary the length of support arm 70 to provide the desired fluid flow between the associated cutter cone assembly 100 mounted on each support arm 70 and convex surface 48 on lower portion 46 of bit body 40. For one application, the length of support arm 70 from top surface 74 to bottom edge 78 is preferably selected to be at least three times the width of support arm 70. Often, it is desirable to provide at least one half inch of clearance between the upper portion of each cutter cone assembly 100 and the adjacent portion of convex surface 48.

As shown in FIG. 3, an enlarged cavity 56 may be formed within upper portion 42 of bit body 40. Opening 58 is provided in upper portion 42 for communicating fluids between drill string 22 and cavity 56. Cavity 56 preferably has a generally uniform inside diameter extending from opening 58 to a position intermediate middle portion 52 of bit body 40. For some applications, cavity 56 may be formed concentric with longitudinal axis 50 of bit body 40.

Since bit body 40 is preferably formed from a single piece of raw material or bar stock, enlarged cavity 56 may be formed by suitable boring and/or drilling techniques. In previous drill bits formed from three segments welded to each other, the corresponding fluid cavity typically contained one or more weld seams in the fluid flow path to the associated nozzles. By providing a one-piece or unitary bit body, the possibility of erosion through weld porosity or a hole in a weld seam has been eliminated.

One or more fluid passageways 62 may be formed in bit body 40 extending between cavity 56 and convex surface 48 on lower portion 46 of bit body 40. Opening 61 may be provided in each fluid passageway 62 adjacent to convex surface 48. A plurality of recesses 63 are preferably provided within each opening 61 to allow installing various types of nozzles or nozzle inserts 60 within each fluid passageway 62. Additional components (not shown) such as a snap ring and/or 0-ring seal may be provided to secure each nozzle insert 60 within recesses 63.

Various techniques are commercially available for satisfactorily installing each nozzle 60 within its associated opening 61. An access hole (not shown) may be provided, in bit body 40 adjacent to each opening 61 to allow installing lock screws or pins (not shown) and/or snap rings and threads (not shown) to retain nozzles 60 within their associated opening 61. For some applications, nozzle inserts 60 may be formed from tungsten carbide or other suitable materials to resist erosion from fluids flowing therethrough. The length and diameter of each fluid passageway 62 may be selected for one application to provide at least partial laminar flow between cavity 56 and the respective nozzle 60. The large, straight passageways 62 minimize turbulence and thus erosion or washout of nozzles 60.

An important feature of the present invention includes the ability to vary the position of fluid passageways 62 and associated nozzles 60 within bit body 40 without affecting the location of pockets 54 and the associated support arms 70. Cavity 56 and one or more fluid passageways 62 with appropriately sized openings 61 may be formed in bit body 40 prior to attachment of support arms 70 and cutter cone assemblies 100. Thus, the present invention allows optimizing the manufacturing procedures associated with forming upper portion 42 with threaded connection 44, middle portion 52 with pockets 54, lower portion 46 with convex surface 48, and cavity 56 with its associated fluid passageways 62 resulting in efficient, cost effective machining sequences.

An end view of bit body 40 is shown in FIG. 4 with three pockets 54 and three fluid passageways 62 with respective openings 61 spaced radially with respect to each other around the perimeter of bit body 40. For the specific example shown in FIG. 4, fluid passageways 62 is spaced radially approximately one hundred twenty degrees (120°) from each other. In a similar manner, each support pocket 54 is spaced radially approximately one hundred twenty degrees (120°) from an adjacent pocket 54. An alternative embodiment of the present invention represented by bit body 140 shown in FIG. 5 includes fluid passageway 162 which extends substantially parallel to and concentric with longitudinal axis 50 of the associated bit body 140. Nozzle 60 having one or more outlet orifices 59 may be disposed within fluid passageway 162 proximate the intersection of the associated convex surface 48 and longitudinal axis 50 of bit body 140.

An important benefit of the present invention includes the ability to vary the position of the respective fluid passageways 62 to direct drilling fluid flow from cavity 56 through each passageway 62 and between adjacent cutter cone assemblies 100 extending from bit body 140. Various locations for fluid passageways 62 may be selected without requiring any change in the location of pockets 54 formed in the exterior of bit body 40. Positioning nozzles 60 and their associated fluid passageways 62 relatively close to longitudinal axis 50 will minimize interference between fluids exiting nozzles 60 and return fluid flow with entrained cuttings. Welding procedures associated with forming a prior art bit body from three segments substantially limited the number of locations available for installing fluid nozzles.

Figure 5:
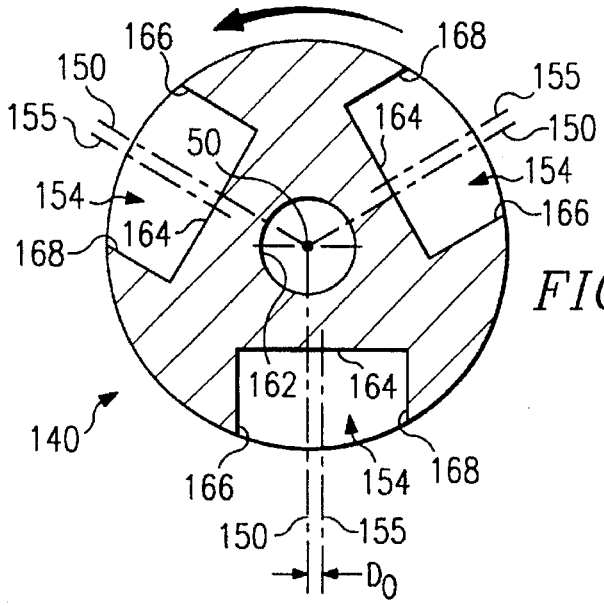
FIG. 5 is a schematic drawing in section showing an offset between the center line of pockets formed in a unitary bit body incorporating another embodiment of the present invention and the projected axis of rotation for an associated drill bit.

As previously noted, an alternative embodiment of the present invention is represented by bit body 140 shown in FIG. 5. Bit body 40 and bit body 140 have essentially the same features except as noted below. For bit body 140 each pocket 154 includes back wall 164 and a pair of side walls 166 and 168. The dimensions of back wall 164 and side walls 166 and 168 are selected to be compatible with the adjacent inside surface and sides of an associated support arm such as support arm 170 shown in FIG. 14. The width ($W_p$) of each pocket is determined by the distance between the associated side walls 166 and 168. An important feature for one embodiment of the present invention includes limiting the combined width of pockets 154 to less than one-half the circumference of bit body 140. By limiting the width of pockets 154, sufficient void spaces may be provided between adjacent support arms to allow for enhanced fluid flow between the support arms and convex surface 48 on the lower portion 46 of bit body 140.

One of the benefits of the present invention includes the ability to vary the radial spacing of support arms 70 and their respective cutter cone assemblies 100 with respect to the projected axis of rotation of the associated drill bit 20 by varying the radial spacing of pockets 54 with respect to longitudinal axis 50 of either bit body 40 and/or 140.

In FIG. 5, radius lines 150 are shown extending radially from the center of bit body 140 which corresponds to longitudinal axis 50. Center line 155 of each pocket 154 is aligned parallel with and offset by distance ($D_O$) from the respective radius line 150. Typically, the amount of offset ($D_O$) is selected to correspond with the desired angular or radial spacing of zero to five or six degrees (0°–5° or 6°) relative to longitudinal axis 50 for the associated support arm and cutter cone assembly 100. When center line 155 of each pocket 154 coincides with the respective radius line 150 there will be no offset between the associated cutter cone assembly 100 and the projected axis of rotation for the resulting drill bit. Depending upon the outside diameter of bit body 140, the amount of offset ($D_O$) may vary from zero to one-half inches to provide the desired offset for the associated cutter cone assembly 100. As previously noted, an important feature of the present invention includes the ability to machine pockets 154 in the associated bit body 140 with the desired offset prior to installing the associated support arms.

Figure 6:
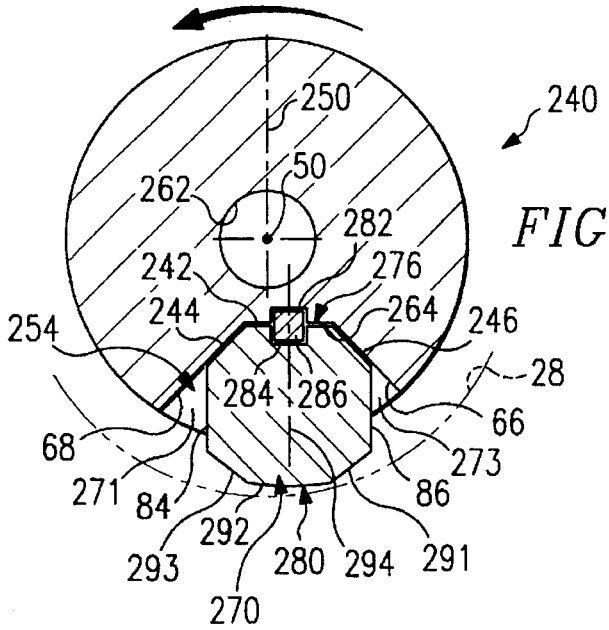
FIG. 6 is a drawing in section showing an alternative configuration of a pocket and support arm incorporating a further embodiment of the present invention.

Another alternative embodiment of the present invention is represented by bit body 240 and support arm 270 shown in FIG. 6. For purposes of illustration only one support arm 270 and its associated pocket 254 are shown in FIG. 6. Typically three support arms 270 and their associated cutter cone assemblies 100 will be mounted on bit body 240 in accordance with the present invention. Bit body 40 and bit body 240 along with support arm 70 and support arm 270 have similar features except as noted below. Bit body 240 is shown with fluid passageway 262 extending substantially parallel with and concentric to longitudinal axis 50. Center line 294 of pocket 254 is shown offset from radius line 250 extending from longitudinal axis 50 and parallel with center line 294.

Pocket 254 includes back wall 264 with side walls 266 and 268 extending at an angle of approximately forty-five degrees (45°) relative to back wall 264. The portion of support arm 270 attached to pocket 254 is shown with a generally octagon shaped cross-section formed in part by inside surface 276, sides 84 and 86 and exterior surface 280. Inside surface 276 includes center surface 242, angled surface 244 and angled surface 246. Surfaces 242, 244 and 246 extend longitudinally from the top edge of support arm 270 throughout the length of pocket 254. Sides 84 and 86 of support arm 270 extend substantially parallel with each other and approximately normal to center surface 242 of inside surface 276. Surfaces 244 and 246 are formed at an angle relative to center surface 242 corresponding generally with the angle formed between side walls 66 and 68 with back wall 264. As will be explained later in more detail, some of the differences between pocket 254 and support arm 270 as compared to pocket 54 and support arm 70 include replacing posts 53 and 54 with keyways 282, 284 and key 286.

The dimensions of inside surface 276 are selected to be compatible with the corresponding back wall 264 and side walls 266 and 268 of pocket 254. The generally octagon shaped cross-section of support arm 270 cooperates with the acutely angled side walls 266 and 268 of pocket 254 to provide void spaces 271 and 273 which may be used to assist in welding support arm 270 in its associated pocket 254. Also, the configuration of pocket 254 is compatible with increasing or decreasing the dimensions of the associated support arm 270 to manufacture drill bits having various gauge diameters from the same size bit body 240.

For the embodiment of the invention shown in FIG. 6, keyway or key slot 282 is formed in back wall 264 and keyway or key slot 284 is formed on inside surface 274. Key 286 is shown disposed in keyways 282 and 284 to assist with proper positioning and alignment of support arm 270 in its associated pocket 254 prior to welding portions of support arm 270 with the perimeter of pocket 254. The length of keyways 282 and 284 and key 286 limited to prevent any interference with the welds formed between support arm 270 and the portion of pocket 254 adjacent to convex surface 48. Various combinations of keys and keyways may be used for alignment and positioning of support arms 70 and 270 in pockets 54 and 254 respectively.

Pockets 54, 154 and 254 are representative of only a few of the various pocket configurations and shapes which may be satisfactorily used with the present invention. Pockets 54, 154 and 254 provide substantial lateral support for a support arm disposed within each pocket during downhole drilling operations. For some applications, it may be preferable to install the majority of the thickness of each support arm within its associated pocket. For other applications, it may be necessary to insert only one-half the thickness of the support arms within their associated pocket. The present invention allows optimizing the configuration of the pockets and their associated support arms based upon the intended downhole application for the resulting drill bit.

Figure 8:
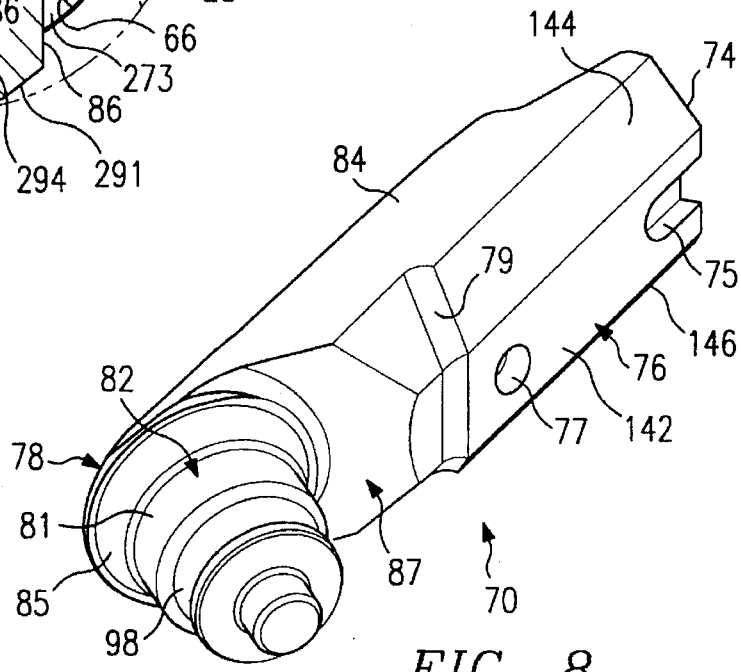
FIG. 8 is an isometric drawing of the support arm shown in FIG. 7.
Figure 7:
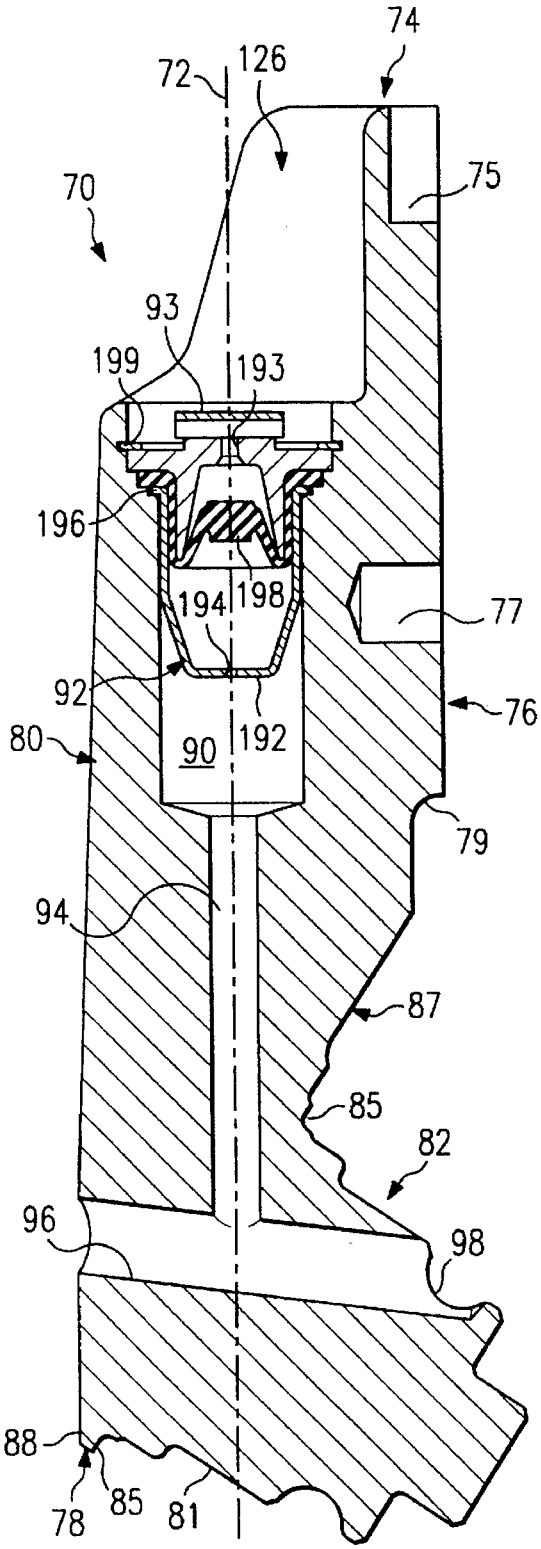
FIG. 7 is an enlarged drawing in section showing a support arm incorporating one embodiment of the present invention.

Support arm 70 incorporating an embodiment of the present invention is shown in more detail in FIGS. 7 and 8. Inside surface 76 of support arm 70 preferably includes center surface 142 with a pair of angled surfaces 144 and 146 extending from center surface 142 to sides 84 and 86, respectively. Angled surfaces 144 and 146 perform essentially the same function as previously described with respect to angled surfaces 244 and 246 of support arm 270. This configuration for support arm 70 is particularly beneficial with respect to pocket 54. Sides 84 and 86 are preferably formed substantially parallel with each other and longitudinal axis 72. Thus, a welding groove is provided between walls 66 and 68 of cavity 54 and the adjacent portions of sides 84 and 86 of support arm 70 as previously described for support arm 270 and pocket 254.

A portion of top surface 74, exterior surface 80 and adjacent sides 84 and 86 have been removed from the upper portion of support arm 70 to provide opening 126 and cavity 90 for installing lubricant reservoir or container 92 therein. Lubricant container 92 has a generally cylindrical configuration compatible with lubricant cavity 90. Lubricant container 92 includes closed end 192 having a lubricant opening 194 extending therethrough. The opposite end of lubricant container 92 has a flanged shoulder 196 supporting a flexible, resilient diaphragm 198 which seals lubricant container 92 from the exterior of the associated drill bit. Cap 93 covers diaphragm 198 and allows fluid pressure from the exterior of support arm 70 through opening 126 to act upon diaphragm 198. Snap ring 199 or another suitable mechanism may be used to install cap 93, diaphragm 198 and container 92 within cavity 90. Opening 193 in cap 93 allows communication of external fluid pressure with diaphragm 198. Lubricant container 92 and lubricant cavity 90 may be filled with a suitable lubricant through a filler port (not shown) in the side of support arm 70. Lubricant container 92 and lubricant passageway 94 cooperate to provide lubrication for bearing assemblies disposed between the exterior of spindle 82 and chamber 114 of the associated cutter cone assembly 100.

Cutter cone assembly 100 may be retained on its associated spindle 82 by inserting a plurality of ball bearings 124 through ball passageway 96 extending from exterior surface 80 of support arm 70 through spindle 82 and ball race 98 in spindle 82. A matching ball race will typically be provided in chamber 114 of cutter cone assembly 100. Once inserted, ball bearings 124 in cooperation with the ball races will prevent disengagement of cutter cone assembly 100 from spindle 82. Ball passage 96 may be subsequently plugged by welding or other well known techniques. For some applications, a ball plug (not shown) may also be placed in passageway 96.

For one application, cavity 90 may be formed along longitudinal axis 72 of support arm 70 with opening 126 extending to the exterior of the associated rock bit 20. Lubricant passageway 94 is preferably formed in support arm 70 as part of cavity 90 to allow communication of lubricant from cavity 90 to ball passageway 96 and ball bearings 124 disposed within ball race 98. The present invention allows forming both cavity 90 and passageway 94 during the same machining process with the same tooling. Boring cavity 90 and passageway 94 at the same time eliminates the need for a separate machine set up and a separate plug weld which is typically associated with forming lubricant passageways in prior drill bits. Since one end of passageway 94 terminates in cavity 90 and the other end of passageway 94 terminates in ball passageway 96, there is no possibility of a plug weld leak or washing out one or more plug welds associated with forming lubricant passageway 94.

Additional passageways (not shown) may be formed within spindle 82 to provide a lubricant flowpath to bearing assembly 122 and any additional bearings associated with cutter cone assembly 100 and spindle 82. By forming cavity 90 substantially parallel with longitudinal axis 72 of the associated support arm 70, lubricant reservoir 92 and the associated cap 93 are better protected during downhole drilling operations by increasing the distance between cap 93 and wall 28 of borehole 24.

A generally circular flat machined area 85 is preferably formed on the exterior of inside surface 76 adjacent to spindle 82. Machined area 85 may sometimes be referred to as the "last machined surface" of support arm 70. A throat relief area 87 is preferably provided on inside surface 76 adjacent to spindle 82 and extending upwardly therefrom. Throat relief area 87 substantially reduces and/or eliminates wear on this surface which is normally caused by abrasive particles and fluids flowing between backface 112 of the associated cutter cone assembly 100 and the lower portion of its associated support arm 70. These fine abrasive particles tend to wear away the lower portions such as shirttail 88 of the associated support arm 70 as cutter cone assembly 100 turns during drilling operations. As this wear increases, the sealing surfaces between spindle 82 and cutter cone assembly 100 may wear such that the associated seals fail.

Figure 9:
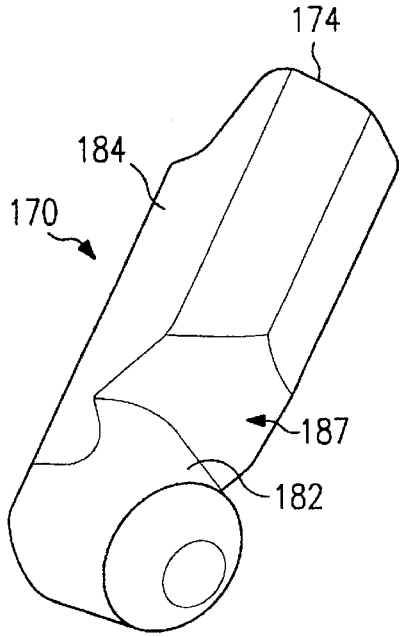
FIG. 9 is an isometric drawing showing one view of a forging used to manufacture the support arm of FIG. 7.
Figure 10:
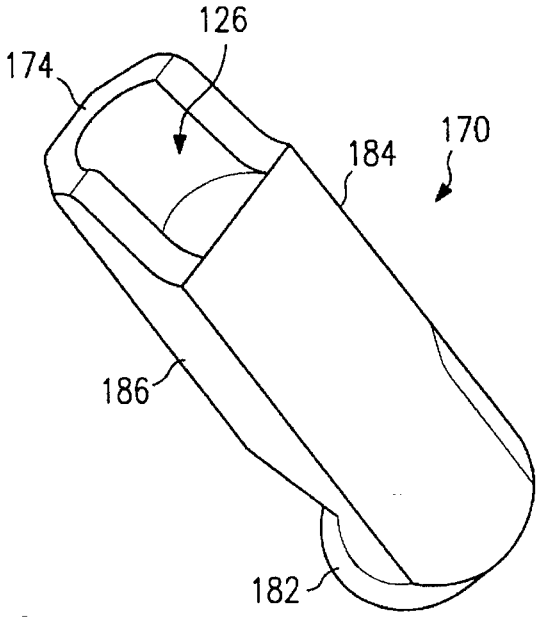
FIG. 10 is an isometric drawing showing another view of the forging used to manufacture the support arm of FIG. 7.

Forging 170 which may be used to manufacture support arm 70 is shown in FIGS. 9 and 10. Since any desired offset in the resulting drill bit 20 is preferably provided by varying the location or offset of pockets 54 with respect to longitudinal axis 50 of the associated bit body 40, the same support arms 70 can be used with various drill bits 20 having different offsets. Since the present invention allows standardization of support arms 70, forgings 170 may be used to substantially reduce the cost and time associated with fabricating each support arm 70.

As shown in FIGS. 9 and 10, forging 170 preferably has the general configuration and overall dimensions compatible with the desired final configuration and dimensions for support arm 70. Boss 182 is preferably provided on the lower portion of each forging 170 projecting inwardly therefrom at an angle corresponding approximately to the desired angle for spindle 82. Top surface 174 of forging 170 corresponds approximately with top surface 74 of support arm 70. Opening 126 is preferably provided in forging 170 for use in machining lubricant cavity 90 and lubricant passageway 94. Sides 184 and 186 of forging 170 correspond generally with sides 84 and 86 of the finished support arm 70. Also, a relieved area 187 may be provided on the inside surface of forging 170 above boss 182 to correspond generally with throat relief area 87 of support arm 70. The machining costs and setup time required to fabricate each support arm 70 may be substantially reduced by starting with forging 170 having approximately the general configuration and overall dimensions required for the finished support arm 70.

FIG. 11 shows bit body 140 with support arm 170 welded within its associated pocket 154. For purposes of illustration, fluid passageway 162 is not shown in bit body 140 in FIG. 11. Also, bit body 140 is shown in FIG. 11 with only one pocket 154 and one support arm 170 attached thereto. As previously noted, posts 53 and 55 may be used to position and align support arms 70 and 170 within pockets 54 and 154 prior to welding. Also, back wall 164 and upper surface 65 cooperate with inside surface 176 and upper end 74 of support arm 170 to establish the desired outside diameter for drill bit 20 as defined by the associated cutter cone assemblies 100.

FIGS. 11, 12 and 13 provide alternative views showing multiple welds 130 formed between the perimeter of pocket 154 and adjacent portions of support arm 170. Weld 130 preferably includes a first portion 132 extending across the top of support arm 170 between upper edge 74 and upper surface 65 of pocket 154. A pair of longitudinal welds 134 and 136 extend between portions of pocket 154 and the adjacent portion of sides 84 and 86, respectively, of support arm 170. Portion 138 of weld 130 extends between inside surface 176 of support arm 170 and the adjacent perimeter of pocket 154 at the intersection with convex surface 48.

The perimeter of pocket 154 may be machined as desired to provide one or more welding grooves to assist in forming multiple welds 132. For one application, a small radius or J-shaped groove 49 may be formed between the intersection of pocket 154 and convex surface 48 to provide a welding groove for attachment of support arm 70 with its associated pocket 54. A similar radius or J-shaped groove 79 may be provided on inside 176 of support arm 170. An important feature of the present invention includes the ability to provide multiple welds 130 extending over the full perimeter of each pocket 154 between the adjacent portions of support arm 170. Welding groove 79 is also shown on inside surface 76 of support arm 70 in FIGS. 3, 7 and 8. For one application, welds 134 and 136 are preferably equal to or longer than the width of the portion of support arm 170 disposed within the associated pocket 154.

For illustration purposes only, bit body 340 is shown in FIG. 14 having two different types of pockets 154 and 254. Support arm 170 is shown disposed in pocket 154 and support arm 270 is shown in pocket 254. Energizer 342 is preferably disposed between inside surface 176 of support arm 170 and back wall 164 of pocket 154. Energizer 344 is preferably disposed between inside surface 276 of support arm 270 and back wall 264 of pocket 254. Energizer 342 may be formed from elastomeric material or other material having sufficiently resilient characteristics to allow limited radial movement of support arm 170 within the associated pocket 154. In a similar manner, energizer 344 may be formed from elastomeric material or any other suitable material which will allow limited radial movement of support arm 270 within pocket 254. Energizers 342 and 344 could also be formed from small springs or Bellville washers as desired.

For one application, energizer 344 may be disposed within keyways 282 and 284 which are used to position and align support arm 280 with its associated pocket 254. As will be explained later in more detail, energizers 342 and 344 may be used to ensure that the associated support arm/cutter cone assemblies are positioned relative to the associated bit body with the desired gauge diameter for the resulting drill bit. Prior to welding each support arm to its associated pocket, energizers 342 or 344 cooperate with welding fixture 200 to maintain cutter cone assemblies 100 at the desired gauge diameter.

Figure 16:
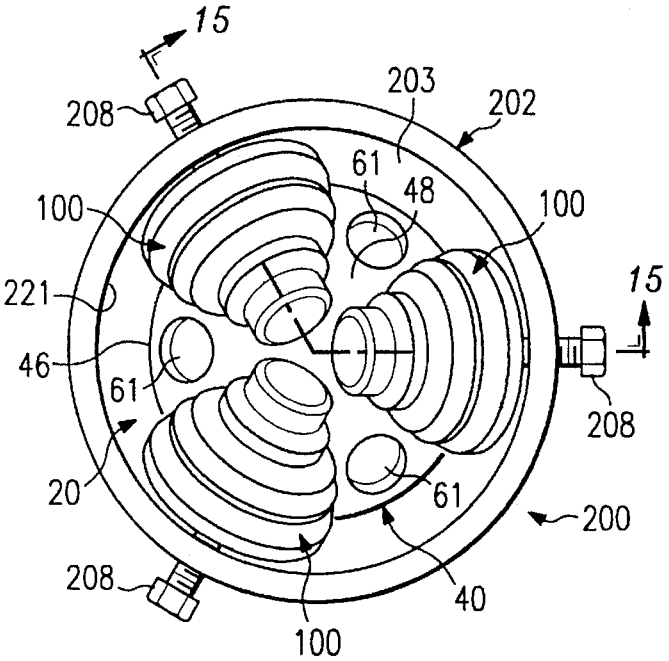
FIG. 16 is an end view of the fixture, bit body and cutter cone assemblies shown in FIG. 15.
Figure 15:
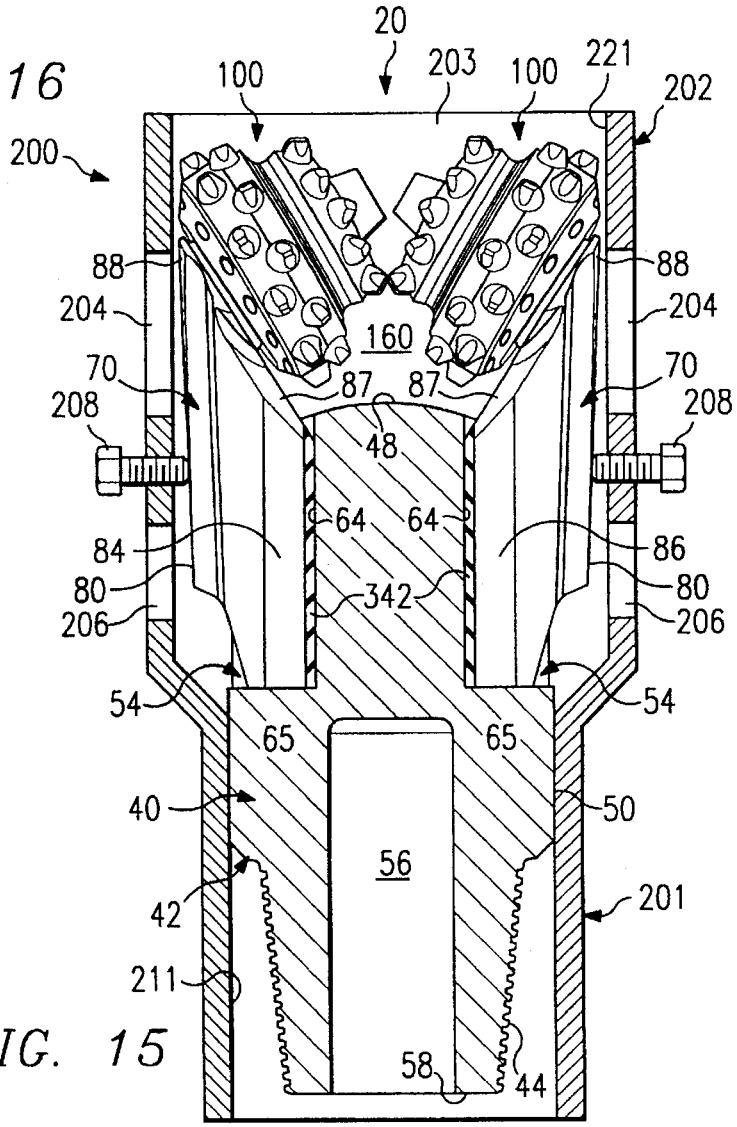
FIG. 15 is a schematic drawing in section showing a unitary bit body with support arms and cutter cone assemblies incorporating one embodiment of the present invention disposed within a fixture for use in welding the support arms to the bit body.

Welding fixture 200 as shown in FIGS. 15 and 16 may be used both during the initial manufacture of drill bit 20 and to rebuild drill bit 20 after use in downhole drilling operations. Welding fixture 200 may be described as a generally hollow cylindrical member sized to receive drill bit 20 therein. Welding fixture 200 comprises a first portion or lower portion 201 and an upper portion or second portion 202. First portion 201 preferably has inside diameter 211 which corresponds to the required gauge diameter for middle portion 52 of bit body 40. Second portion 202 preferably has inside diameter 221 corresponding with the desired gauge diameter for cutter cone assemblies 100 of the resulting drill bit 20. Second portion 202 preferably includes opening 203 which will allow inserting bit body 40, support arms 70 and their associated cutter cone assemblies 100 within fixture 200 prior to welding each support arm 70 with its associated pocket 54. First portion 201 and second portion 202 are preferably aligned concentric with each other.

First cutter cone assemblies 100 are preferably mounted on their associated spindle 82. Each support arm 70 may then be positioned and aligned within its associated pocket using either posts 53 and 55 in cooperation with opening 75 and 77 or keyways 282 and 284 along with key 286 as previously desired. Post 53 and opening 75 or keyways 282 and 284 are preferably located a sufficient distance from the perimeter of pocket 54 to avoid any interference with welds 130. Energizer 342 may be disposed between each support arm 70 and back wall 64 of the associated pocket 54. For some applications, energizer 344 may be used in place of energizer 342. Windows 204 and 206 are provided at various locations in second portion 202 to allow access for spot welding around the perimeter of each pocket 54 and adjacent portions of the associated support arm 70.

Three positioning screws 208 are preferably provided within second portion 202 between windows 204 and 206. Drill bit 20 may be positioned within welding fixture 200 such that each support arm 70 and its associated pocket 54 are disposed adjacent to respective windows 204 and 206. Also, each support arm 70 is preferably positioned adjacent to its associated adjusting screw 208. Adjusting screw 208 in cooperation with energizer 342 may be used to position the associated support arm 70 and cutter cone assembly 100 as required to obtain the desired gauge diameter for the resulting drill bit 200. For example, by tightening adjusting screw 208 against exterior surface 80 of the associated support arm 70, the respective energizer 342 will be compressed, allowing the respective cutter cone assembly 100 to move radially inward with respect to longitudinal axis 50. In a similar manner, adjusting screw 208 may be rotated in the opposite direction to allow the associated energizer 342 to expand and move the respective support arm 70 and cutter cone assembly 100 radially outward with respect to longitudinal axis 50. Thus, energizers 342 in cooperation with welding fixture 200, including adjusting screws 208, allow positioning each support arm 70 and its associated cutter cone assembly 100 to obtain the desired drill bit diameter and required geometric configurations for the resulting drill bit 20.

After sufficient spot welds have been placed between the perimeter of each pocket 54 and adjacent portions of support arm 70, drill bit 20 may be removed from welding fixture 200. Multiple welds 130 may then be formed around the full perimeter of pocket 54 and adjacent portions of support arm 70 using conventional welding techniques. For some applications, it may be desirable to replace adjusting screws 208 with hydraulic and/or pneumatically actuated clamps. Various modifications may be made to welding fixture 200 to allow for relatively high volume, automated welding of support arms 70 with pockets 54.

The use of energizer 342 and/or 344 in cooperation with welding fixture 200 allows greater tolerance in the specified dimension associated with pockets 54, support arms 70 and cutter cone assembly 100. For example, these components may be manufactured with as built dimension resulting in a drill bit diameter less than desired when support arm 70 are mounted in their associated pocket 54. By placing energizer 342 between each support arm 70 and its associated back wall 64, each support arm 70 is projected radially outward a limited distance with respect to the associated pocket 54. Welding fixture 200 and adjusting screws 208 may be used to compress energizers 342 and position the respective support arms 70 and cutter cone assemblies 100 at the proper location to ensure both the desired drill bit diameter and maintain concentricity of cutter cone assemblies 100. Due to the configuration of pockets 54 and the associated support arm 70, adjusting screw 208 will cause movement of support arm 70 and its associated cutter cone assembly 100 only in the radial direction with respect to longitudinal axis 50. Thereby, the desired drill bit diameter can be obtained without compromising any desired offset with respect to longitudinal axis 50.

For some applications, welding fixture 20 may be used to spot weld support arms 70 within their associated pocket 54 without the use of energizers 342. For this application, adjusting screws 280 may be tightened to provide the desired concentric relationship of cutter cone assemblies 100 and the gauge diameter resulting from the as built dimensions for pockets 54 and support arms 70. Alternatively, a shim or similar mechanism could be placed between back wall 64 and inside surface 76 to vary the radial position of the associated support arm 70 in cooperation with adjusting screw 280.

One or more support arms 70 and associated cutter cone assemblies 100 may be removed from bit body 40 to rebuild drill bit 20 using the same bit body 40 and/or to use the removed support arms 70 and cutter cone assemblies 100 to rebuild another drill bit. The present invention allows reuse of the bit body, support arms and/or cutter cone assemblies depending upon the respective condition of each component after the associated drill bit has been used for drilling operations.

Drill bit 20 may be rebuilt by removing one or more support arms 70 from their associated pocket 54. A carbon arc or other suitable process may be used to cut multiple welds 130 to release each support arm from its associated pocket. The respective support arm 70 or 170 and cutter cone assembly 100 may be replaced as desired. If bit body 40 or 140 is damaged, each support arm 70 or 170 and cutter cone assembly 100 may be removed therefrom and installed on another bit body 40 or 140. Openings 126 in the exterior of each support arm and the configuration of pockets 54, 154 or 254 provide reference points for cutting welds 130 between each support arm and its associated pocket. Also, the clearance provided between each cutter cone assembly 100 and convex surface 48 allows cutting welds 130 without damaging the respective cutter cone assembly 100.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a convex surface and a void space formed between said convex surface and said cutter cone assemblies;

a middle portion disposed between said upper portion and said lower portion of said bit body, said middle portion having a generally cylindrical configuration with an exterior surface defined in part by said cylindrical configuration;

a number of radially spaced pockets formed in the exterior of said middle portion of said bit body;

each of said pockets having a back wall for attaching said support arms to said bit body with said number of pockets equaling said number of support arms;

each of said pockets having a pair of side walls extending at an angle from said back wall; and said side walls extending from said respective back wall for each pocket to said exterior surface of said middle portion of said bit body.

2. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a convex surface and a void space formed between said convex surface and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

each of said pockets having a pair of side walls extending at an angle from said back wall;

a welding groove formed between the perimeter of each pocket and adjacent portions of said support arm disposed within said pocket; and multiple welds formed in said welding groove between each support arm and its associated pocket with said multiple welds extending over the full perimeter of each pocket and adjacent portions of said support arm.

3. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion having a convex surface with a void space formed between said convex surface and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms; and an energizer disposed between a portion of said inside surface of each support arm and said back wall of its associated pocket.

4. A rotary cone drill bit for forming a borehole having a side wall and bottom comprising:

a one-piece bit body having an under portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a convex surface and a void space formed between said convex surface and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

each of said pockets having a pair of side walls extending at an angle from said back wall; and a longitudinal weld formed between each side of said support arms and adjacent portions of said pockets with the length of each longitudinal weld longer than the width of said support arms.

5. A rotary cone drill bit for forming a borehole having a side wall and bottom in combination with a welding fixture comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion having a convex surface with a void space formed between said convex surface and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

said drill bit disposed within said welding fixture having a first portion and a second portion;

said first portion having a generally cylindrical configuration with an inside diameter corresponding with the outside diameter of said middle portion of said bit body;

said second portion having a generally cylindrical configuration with an inside diameter corresponding with a gauge diameter for said cutter cone assemblies of said drill bit;

multiple windows formed in said second portion for use in welding portions of each support arm with its associated pocket; and said windows disposed in said second portion adjacent to said pockets.

6. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a convex surface and a void space formed between said lower portion and said cutter cone assemblies;

a middle portion disposed between said upper portion and said lower portion of said bit body, said middle portion having a generally cylindrical configuration;

a number of radially spaced pockets formed in the exterior of said middle portion of said bit body;

each pocket having a back wall and a pair of side walls extending at an angle from said back wall; and multiple welds formed between each pocket and said respective support arms to attach said support arms to said bit body with said number of pockets equaling said number of support arms.

7. The drill bit as defined by claim 6 further comprises:

a welding groove formed between the perimeter of each pocket and adjacent portions of said support arm disposed within said pocket; and said multiple welds formed in part in said welding groove between each support arm and its associated pocket with said multiple welds extending over the full perimeter of each pocket and adjacent portions of said support arm.

8. The drill bit as defined by claim 6 further comprising a longitudinal weld formed between each side of said support arms and adjacent portions of said pockets with the length of each longitudinal weld longer than the width of said support arms.

9. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a void space formed between said lower portion and said cutter cone assemblies;

a middle portion disposed between said upper portion and said lower portion of said bit body, said middle portion having a generally cylindrical configuration;.

a number of radially spaced pockets formed in the exterior of said middle portion of said bit body having a back wall for attaching said support arms to said bit body with said number of pockets equaling said number of support arms; and an energizer disposed between a portion of said inside surface of each support arm and said back wall of its associated pocket.

10. A rotary cone drill bit for forming a borehole having a side wall and bottom in combination with a welding fixture comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a void space formed between said lower portion and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

said drill bit disposed within said welding fixture having a first portion and a second portion;

said first portion having an inside diameter corresponding with the outside diameter of said middle portion of said bit body;

said second portion having an inside diameter corresponding with a gauge diameter for said cutter cone assemblies of said drill bit;

multiple windows formed in said second portion for use in welding portions of each support arm with its associated pocket; and a plurality of adjusting screws provided within said second portion to allow positioning said support arms within said pockets.

11. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a convex surface and a void space formed between said lower portion and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

a welding groove formed between the perimeter of each pocket and adjacent portions of said support arm disposed within said pocket;

multiple welds formed in said welding groove between each support arm and its associated pocket with said multiple welds extending over the full perimeter of each pocket and adjacent portions of said support arm; and a longitudinal weld formed between each side of said support arms and adjacent portions of said pockets with the length of each longitudinal weld longer than the width of said support arms.

12. A rotary cone drill bit for forming a borehole having a side wall and bottom comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a void space formed between said lower portion and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

a welding groove formed between the perimeter of each pocket and adjacent portions of said support arm disposed within said pockets; and multiple welds formed in said welding groove between each support arm and its associated pocket with said multiple welds extending over the full perimeter of each pocket and adjacent portions of said support arms; and an energizer disposed between a portion of said inside surface of each support arm and said back wall of its associated pocket.

13. A rotary cone drill bit for forming a borehole having a side wall and bottom in combination with a welding fixture comprising:

a one-piece bit body having an upper portion adapted for connecting said drill bit to a drill string for rotation of said drill bit;

a number of radially spaced support arms attached to said bit body and extending opposite from said upper portion, each of said support arms having an inside surface with a spindle connected thereto, each spindle projecting generally downwardly and inwardly with respect to its associated support arm;

a number of cutter cone assemblies equaling said number of support arms with one of said cutter cone assemblies mounted respectively on each spindle for boring engagement with said side wall and bottom of said borehole;

said bit body having a lower portion with a void space formed between said lower portion and said cutter cone assemblies;

a middle portion disposed between said upper portion and said lower portion of said bit body, said middle portion having a generally cylindrical configuration;

a number of radially spaced pockets formed in the exterior of said middle portion of said bit body having a back wall for attaching said support arms to said bit body with said number of pockets equaling said number of support arms;

a welding groove formed between the perimeter of each pocket and adjacent portions of said support arm disposed within said pockets; and multiple welds formed in said welding groove between each support arm and its associated pocket with said multiple welds extending over the full perimeter of each pocket and adjacent portions of said support arms;

said drill bit disposed within said welding fixture, said welding fixture having a first portion and a second portion;

said first portion having a generally hollow, cylindrical configuration with an inside diameter corresponding with the outside diameter of said middle portion of said bit body;

said second portion having a generally hollow, cylindrical configuration with an inside diameter corresponding with a gauge diameter for said cutter cone assemblies of said drill bit; and multiple windows formed in said second portion of said welding fixture for use in welding portions of each support arm with its associated pocket.

* * * * *